US006883892B2

(12) United States Patent
Sievert et al.

(10) Patent No.: US 6,883,892 B2
(45) Date of Patent: Apr. 26, 2005

(54) PRINTING APPARATUS CALIBRATION

(75) Inventors: Otto K. Sievert, Oceanside, CA (US); Gregory D. Nelson, Escondido, CA (US); Robert D. Blanton, San Diego, CA (US); Shawn B. Nielson, San Diego, CA (US); Patrick Chase, San Diego, CA (US); Michael Hall, Temecula, CA (US); Padmanabhan Ramchandran, San Diego, CA (US); Joseph E. Powell, Sna Diego, CA (US); Steve T. Breidenbach, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 18 days.

(21) Appl. No.: 10/286,635

(22) Filed: Oct. 31, 2002

(65) Prior Publication Data

US 2004/0085378 A1 May 6, 2004

(51) Int. Cl.[7] ..... B41J 29/393
(52) U.S. Cl. ..... 347/19; 347/3; 358/406
(58) Field of Search ..... 347/3, 19; 358/406, 358/472, 504; 399/15, 72

(56) References Cited

U.S. PATENT DOCUMENTS

| | | | | |
|---|---|---|---|---|
| 4,675,696 | A | | 6/1987 | Suzuki |
| 4,831,420 | A | * | 5/1989 | Walsh et al. ..... 399/16 |
| 4,922,268 | A | | 5/1990 | Osborne |
| 4,922,270 | A | | 5/1990 | Cobbs et al. |
| 5,036,340 | A | | 7/1991 | Osborne |
| 5,109,239 | A | | 4/1992 | Cobbs et al. |
| 5,289,208 | A | | 2/1994 | Haselby |
| 5,297,017 | A | | 3/1994 | Haselby et al. |
| 5,313,287 | A | | 5/1994 | Barton |
| 5,397,192 | A | | 3/1995 | Khormaee |
| 5,404,020 | A | | 4/1995 | Cobbs |
| 5,448,269 | A | | 9/1995 | Beauchamp et al. |
| 5,451,990 | A | | 9/1995 | Sorenson et al. |
| 5,491,568 | A | | 2/1996 | Wan |
| 5,530,460 | A | | 6/1996 | Wehl |
| 5,534,895 | A | | 7/1996 | Lindenfelser et al. |
| 5,600,350 | A | | 2/1997 | Cobbs et al. |
| 5,619,307 | A | * | 4/1997 | Machino et al. ..... 399/11 |
| 5,642,202 | A | | 6/1997 | Williams et al. |
| 5,649,073 | A | | 7/1997 | Knox et al. |
| 5,796,414 | A | | 8/1998 | Sievert et al. |
| 5,835,108 | A | | 11/1998 | Beauchamp et al. |
| 5,847,722 | A | | 12/1998 | Hackleman |
| 5,856,876 | A | * | 1/1999 | Sasanuma et al. ..... 358/300 |
| 5,884,118 | A | | 3/1999 | Mestha et al. |
| 5,980,016 | A | | 11/1999 | Nelson et al. |
| 6,048,117 | A | | 4/2000 | Banton |
| 6,076,915 | A | | 6/2000 | Gast et al. |
| 6,106,095 | A | * | 8/2000 | Jackson et al. ..... 347/19 |
| 6,109,722 | A | | 8/2000 | Underwood et al. |
| 6,161,914 | A | | 12/2000 | Haselby |
| 6,164,750 | A | | 12/2000 | Subirada et al. |
| 6,172,771 | B1 | | 1/2001 | Ikeda et al. |
| 6,191,867 | B1 | | 2/2001 | Shor et al. |
| 6,193,350 | B1 | | 2/2001 | Hadley |
| 6,196,652 | B1 | | 3/2001 | Subirada et al. |
| 6,215,562 | B1 | | 4/2001 | Michel et al. |

(Continued)

*Primary Examiner*—Lamson Nguyen
*Assistant Examiner*—Blaise Mouttet

(57) ABSTRACT

A printing component receives media, applies print imaging thereto, and delivers the media to a first location. The apparatus selectively applies at least one calibration mark as the print imaging. An imaging component receives the imaged media at a second location and produces scan data representative thereof. The apparatus selectively analyzes the at least one calibration mark and produces calibration data.

49 Claims, 8 Drawing Sheets

U.S. PATENT DOCUMENTS 6,241,334 B1 6/2001 Haselby
6,268,930 B1 7/2001 Ohta et al.
6,271,934 B1 8/2001 Hayashi
6,275,600 B1 8/2001 Banker et al.
6,290,320 B1 9/2001 Beauchamp et al.
6,297,888 B1 10/2001 Noyes et al.
6,334,660 B1 1/2002 Holstun et al.
6,347,857 B1 2/2002 Purcell et al.
6,366,306 B1 4/2002 Fukuda
6,390,587 B1 5/2002 Subirada

* cited by examiner

PRINTING APPARATUS CALIBRATION

BACKGROUND OF THE INVENTION

A printer mechanism or printing apparatus may include one or more print cartridges.

Each print cartridge includes one or more ink ejecting orifice arrays and is associated with at least one particular type or color of ink. Users dismount and mount print cartridges for various reasons, e.g., to select a different type of ink, different ink color, or to remove and replace an empty print cartridge.

Accurate mechanical registration among the print cartridges and orifices carried thereby is needed to provide high print quality. Variation in relative position among the print cartridges and with respect to the print cartridge carriage can affect the final result, e.g., when the print cartridge position as mounted on the carriage varies the printer mechanism can lack accurate, known, registration between the print cartridges and the media.

Due to mechanical variation in print cartridge mounting on a print cartridge carriage, such registration does not always occur. A given printer mechanism and print cartridge carriage may be designed to suitably align, in both the horizontal (scan axis) direction and the vertical (media advance axis) direction, the orifices on different print cartridges. Variation, e.g., along the media axis, may occur, especially after a print cartridge has been mounted or dismounted.

Such vertical and horizontal offsets are typically considered when coordinating production of print imaging by ejecting ink droplets from one or more print cartridges. In addition, a printer mechanism can be further calibrated or aligned relative to non-spatial aspects of the printing mechanism, e.g., performance aspects such as energy use and mechanical aspects including carriage movement and bi-directional printing control.

Calibration or alignment can bring a printer mechanism closer to its intended level of print imaging quality.

Because such calibrations do not persist over time for a given printer mechanism, printer mechanisms often include calibration procedures and functions. Typically, once a set of print cartridges is mounted upon the print cartridge carriage and a suitable calibration is performed, re-calibration is not needed again until after a print cartridge is dismounted. Re-calibration may be performed, however, at any time. For example, a user detecting reduced quality in print imaging can initiate a re-calibration procedure by suitably interacting with a printer mechanism or computer or computer network attached thereto. Generally, calibration is performed when a print cartridge is mounted as such event gives rise to opportunity for a change, for example, in relative cartridge-to-cartridge and in relative cartridge-to-carriage registration.

A user could be asked to perform complex or burdensome calibration tasks, but as a practical matter the limits of user tolerance and ability fall short of a complete spectrum of the calibration tasks needed to bring a particular printer mechanism to a desired performance level. Also, users as a population typically cannot consistently interpret and judge calibration marks, and therefore generally do not reliably produce consistent print imaging through a corresponding population of printer mechanisms through participation in a calibration procedure. As a result, "manual" methods of calibration are often simplified, with the adverse effect that the complexity and number of calibration parameters presented are often less than those desirably performed for best print imaging results.

Printing systems having "automatic" calibration and alignment methods that do not require such complex involvement from users generally are more expensive due to the additional components required to automate the calibration. Also, placing an optical sensor on a print cartridge carriage in implementation of an "automatic" method introduces significant challenge in producing accurate scanning data due to the rapid reciprocating or scanning motion of such carriage and hysteresis reflected therein.

For these and other reasons, there is a need for the present invention.

SUMMARY OF THE INVENTION

A printing component receives media, applies print imaging thereto, and delivers the media to a first location. The apparatus selectively applies at least one calibration mark as the print imaging. An imaging component receives the imaged media at a second location and produces scan data representative thereof. The apparatus selectively analyzes the at least one calibration mark and produces calibration data.

The subject matter of the present invention is particularly pointed out and distinctly claimed in the concluding portion of this specification. However, both the organization and method of operation of embodiments, together with further advantages and objects thereof, may best be understood by reference to the following description taken with the accompanying drawings wherein like reference characters refer to like elements.

BRIEF DESCRIPTION OF THE DRAWINGS

For a better understanding of embodiments, and to show how the same may be carried into effect, reference will now be made, by way of example, to the accompanying drawings in which.

DETAILED DESCRIPTION OF THE PREFERRED EMBODIMENT

Figure 1:
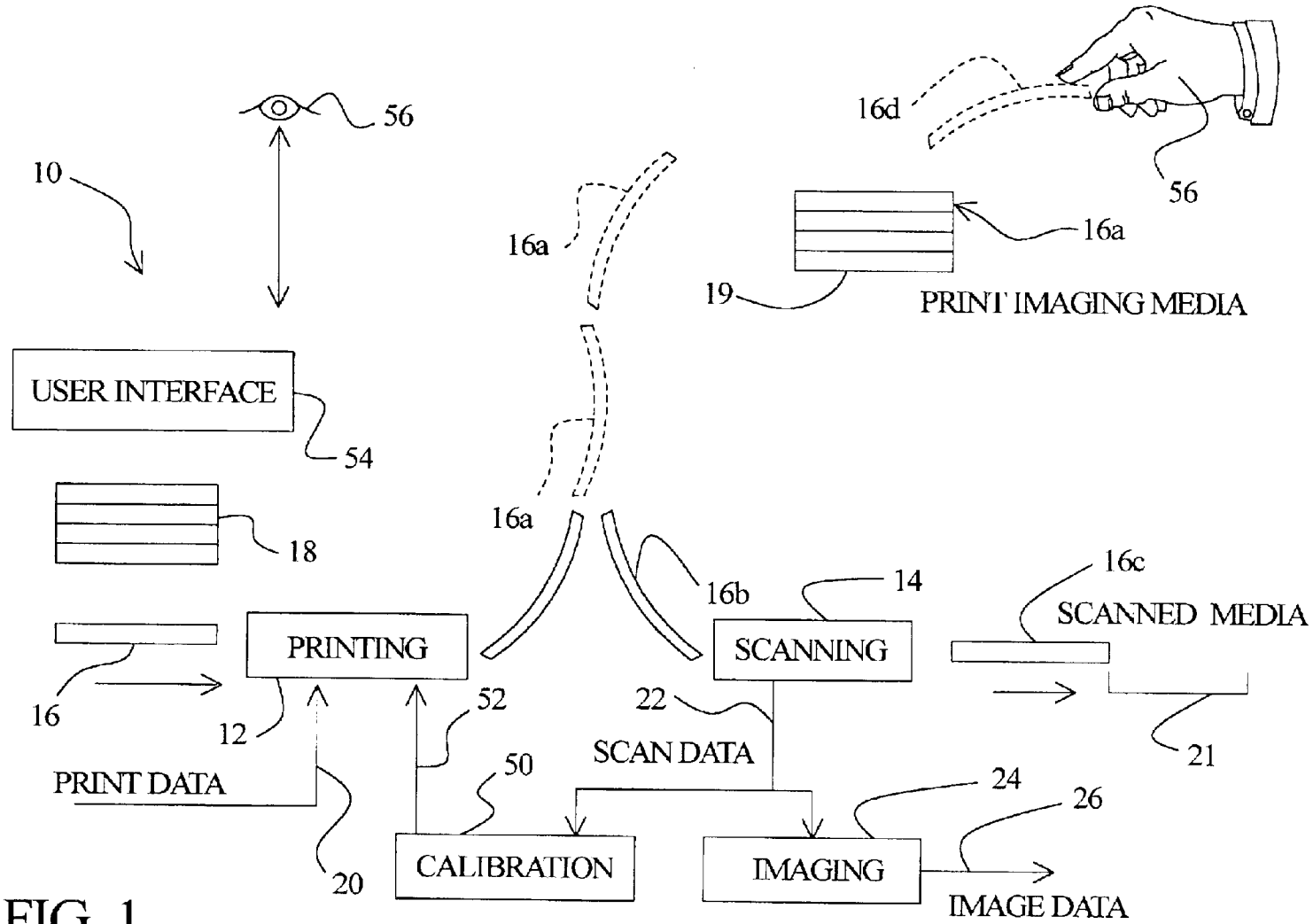
FIG. 1 illustrates schematically a multifunction printing and imaging machine according to an embodiment of the present invention.

FIG. 1 illustrates schematically a multifunction printer and imaging machine 10. In FIG. 1, machine 10 includes a printing component 12 and a scanning component 14. Printing component 12 accepts media 16 from a media source 18 and produces as output print imaging or printed media 16*a*. Printing component 12 delivers printed media 16*a* at an output tray 19. Printing component 12 reacts to print data 20, e.g., as provided by external and internal devices or processes, to produce media 16*a* bearing print imaging according to print data 20. Machine 10, as an "all-in-one" machine, can include additional features and functions, e.g., that permit it to operate as a stand-alone copy machine or as a FAX machine, but such additional features and functions will not be specifically discussed herein for simplicity in the present discussion. Accordingly, application of the present invention shall not be limited to the particular form of multifunction printer and scanner or feature set thereof as illustrated herein.

As discussed more fully hereafter, printing component 12 includes a calibration feature that modifies ink droplet ejection and other printer component 12 operation relative to that otherwise produced in response to print data 20. It will be understood, however, that a calibration feature need not necessarily be incorporated into printing component 12. For example, calibration procedures and algorithms could be executed externally of machine 10 by suitably passing information between machine 10 and an associated computing device (not shown) wherein calibration features can be implemented as described herein. In either case, modification of printing component 12 operations occurs as a function of calibration or alignment procedures applied thereto. For the present discussion, such modification shall be referred to as calibration or alignment of printing component 12.

Scanning component 14 receives imaged media 16*b* and produces scan data 22. Scanning component 14 delivers imaged media 16*b* at its output tray 21 as scanned media 16*c*. Depending on the mechanical architecture of a particular machine 10, output trays 19 and 21 can be coincident. An imaging component 24 receives scan data 22 and provides image data 26 externally of machine 10, e.g., to a computer system (not shown) for further processing or storage. Scanning component 14 receives imaged media 16*b* by a variety of methods, e.g., by placement on a flatbed scanner or by insertion into a document feeder mechanism. Media 16 exiting printing component 12 does not normally directly enter scanning component 14. In other words, media 16 feed mechanisms (not shown) downstream from printing component 12 do not normally couple to the infeed portions of scanning component 14.

Thus, machine 10 serves as a multifunction device providing both print imaging functions, e.g., applying print imaging to media 16 to produce media 16*a*, and scan imaging functions, e.g., receiving imaged media 16*b*, producing scan data 22, and providing by way of imaging component 24 image data 26 representing scanned media 16*c*. As such, machine 10 serves as an integrated or "all-in-one" multifunction printing and imaging machine.

Machine 10 further includes a calibration component 50. As noted above, calibration component 50 need not necessarily be included within machine 10, e.g., calibration component can be incorporated into an associated computing device coupled to machine 10 and suitably programmed for communication and interaction with machine 10 to accomplish calibration as described herein. Machine 10 directs, under suitable circumstances, scan data 22 to calibration component 50 to produce calibration data 52. Calibration data 52 applies to printing component 12 in support of calibration or alignment thereof. Thus, for example, calibration data 52 modifies the timing of ink droplet ejection, pairing of ink droplet-ejecting orifices, operation of bi-directional printing operations, color alignment, or interpretation of print data 20 within printing component 12. In this manner, print imaging produced by printer component 12 achieves improved precision in its final form by taking into account, for example, actual registration between print cartridges, orifices, print cartridges and cartridge carriages, and relative movement between print cartridges and media 16 moving therepast.

Machine 10 includes a user interface component 54 for interacting with a user 56. It will be understood, however, that interface component 54 need not be included as a feature of machine 10, but rather can be incorporated into display features of an associated computing device in communication with machine 10. Interface component 54 can include, for example, a display and a keypad or buttons for interaction with user 56. As discussed herein below, user 56 participates in a calibration procedure orchestrated by machine 10 in support of improved print imaging within component 12.

Interaction between machine 10 and user 56 supports the calibration procedure generally as follows. Machine 10 informs user 56, e.g., by way of interface component 54, that a calibration procedure is recommended. In the alternative, or as a supplement to interface component 54, machine 10 can present instructions as to the calibration procedure by print imaging, e.g., by presentation on a calibration page 16*d*. User 56 receives from printing component 12 a calibration page 16*d*. Calibration page 16*d* is produced according to print imaging features of printing component 12, and includes calibration marks thereon. Calibration page 16*d* as produced by printing component 12 is made available to user 56 in manner similar to media 16*a*. For example, calibration page 16*d* is made available to user 56 at tray 19. User 56 collects calibration page 16*d* from tray 19 and applies calibration page 16*d* to scanning component 14 in manner similar to imaged media 16*b*. Machine 10 detects and suitably reacts to calibration page 16*d* appearing in scan data 22 by providing such scan data 22 to calibration component 50. Calibration component 50 analyzes scan data 22 representing a calibration page 16*d* and produces appropriate calibration data 52 for application to printing component 12. Printing component 12 makes use of calibration data 52 to suitably interpret and react to print data 20 taking into account calibration data 52 to suitably, e.g., precisely, produce print imaging on media 16*a*.

For example, given a printing component 12 operating according to inkjet printing methods, e.g., a print cartridge carriage carrying one or more cartridges moving relative to media 16 and ejecting ink droplets, calibration data 52 can provide timing adjustments as a function of actual or detected horizontal registration among such cartridges and actual registration between a collection of cartridges and media 16 moving in relation thereto. Similarly, calibration data 52 can provide a basis for adjusting ink droplet-ejecting orifice pairing between different print cartridges of printer component 12. In other words, pairing of orifices on different cartridges can be a function of detected vertical registration therebetween as reflected in calibration data 52. By re-pairing orifices having closer or, preferably, substantially identical vertical offsets, improved print imaging within printing component 12 results. Furthermore, calibration data 52 can provide a basis for modifying interpretation of print data 22 to reflect, for example, the actual vertical and horizontal offsets of the print cartridges in the carriage or other machine 10 conditions, and thereby accomplish calibration or alignment of printing component 12.

Thus, scan data 22 has two uses. First, scan data 22 is transferred, when appropriate, to imaging component 24 to produce image data 26 representing scanned media 16*c* for delivery to an external device or other process, e.g., a computer or computer network attached thereto or to printer component 12 in a media copying function or to a FAX component (not shown) in a communication function. In an imaging use, scan data 22 supports an imaging function of machine 10. During a calibration procedure, however, scan data 22 representing a calibration page 16*d* can apply to calibration component 50 to produce calibration data 52 which thereafter modifies operation of printing component 12 according to the detected actual alignment or registration of image producing devices, e.g., ink droplet-ejecting orifices, within printing component 12. Accordingly, printing component 12 thereafter makes use of calibration data 52 to better produce print imaging on media 16*a* when modified according to calibration data 52.

Figure 2:
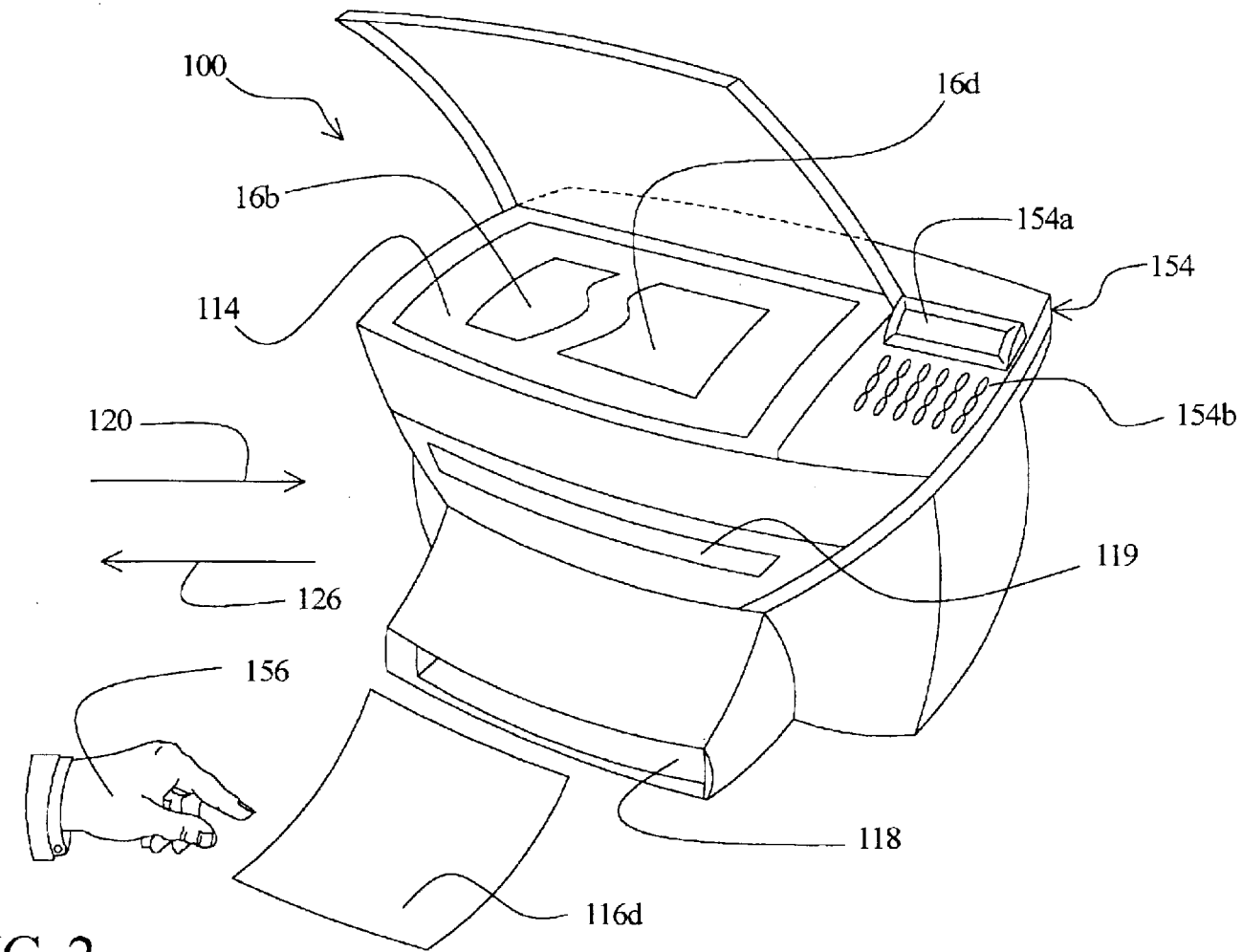
FIG. 2 illustrates a second embodiment according to the present invention of a multifunction printing and imaging machine.
Figure 3:
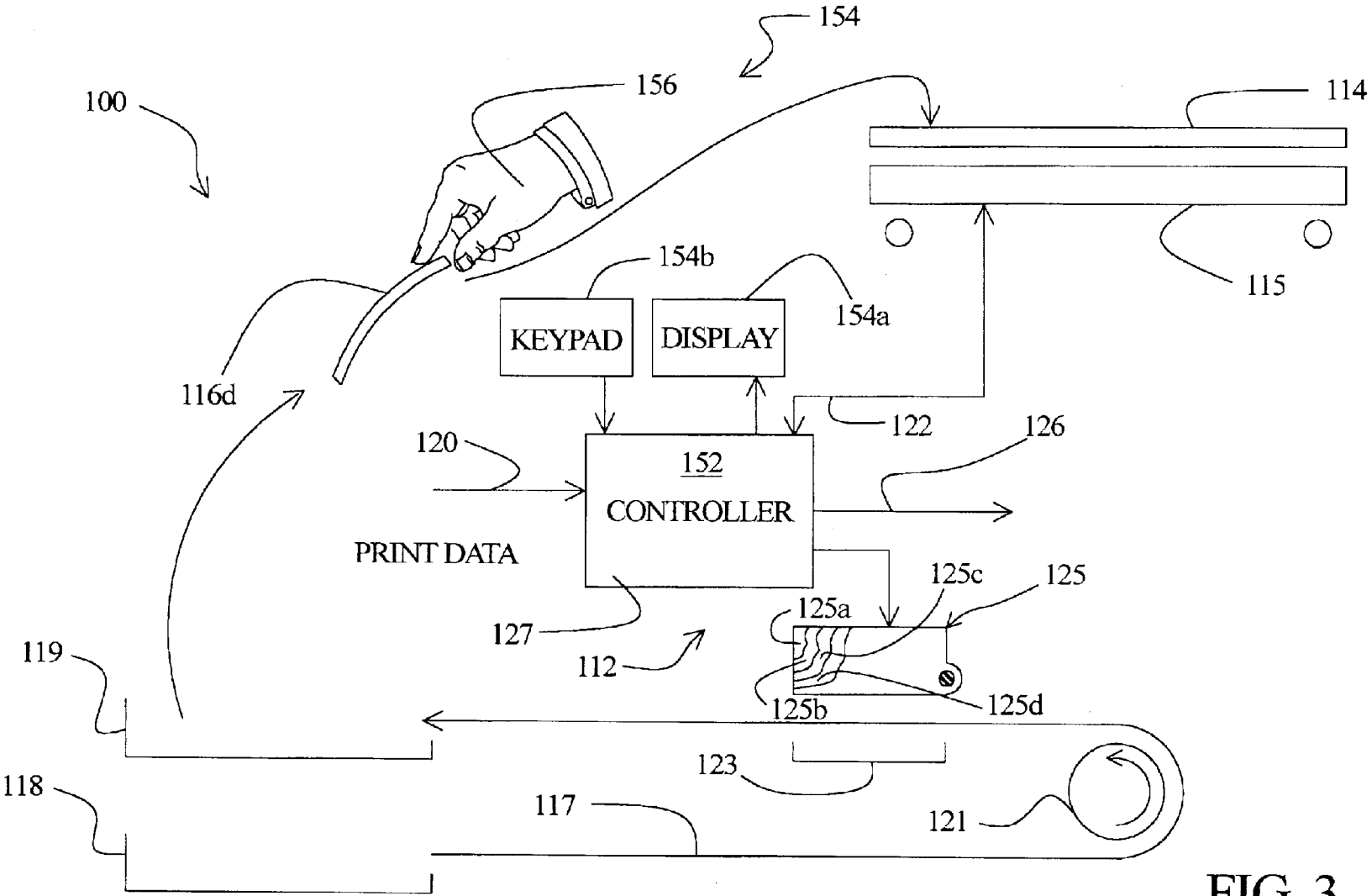
FIG. 3 illustrates schematically components according to an embodiment of the present invention of the multifunction printing and imaging machine of FIG. 2.

FIG. 2 illustrates as a second embodiment a multifunction printing and imaging machine 100. FIG. 3 illustrates schematically additional, e.g., internal, components of machine 100 including in schematic fashion media feed paths and uses relative to machine 100 as well as control elements supporting operation of machine 100 in printing and imaging functions and in calibration functions as described hereafter.

With reference to FIGS. 2 and 3, machine 100 includes a media source or input tray 118 and receives print data 120 from, for example, an associated computer or computer network (not shown). Machine 100 collects media 116 from tray 118 and produces print imaging thereon according to print data 120. More particularly, media 116 travels from tray 118 along a media feed path 117 as defined by a media feed mechanism 121 past a print zone 123 and into an output tray 119. As media 116 passes through print zone 123, a print cartridge carriage 125 reciprocates through a print zone 123 and applies print imaging thereto. In the particular embodiment illustrated in FIG. 3, print cartridge carriage 125 carries four print cartridges, individually cartridges 125*a*, 125*b*, 125*c*, and 125*d*. It will be understood, therefore, that mounting of cartridges 125*a*–125*d* can include slight variation in vertical or horizontal position relative to one another, relative to carriage 125, and relative to machine 100 generally. Suitable calibration of machine 100 can account, however, for such variation to produce high quality print imaging. Carriage 125 includes one or more print cartridges (not shown), each carrying an array of ink droplet-ejecting orifices. Collectively, controller 127 and carriage 125, including one or more print cartridges mounted thereon, form a printing component 112 of machine 100. Print data 120 as applied to controller 127 in conjunction with programming of controller 127 produces corresponding print imaging by way of print cartridges carried on carriage 125.

The controller 127 orchestrates operation of machine 100 in collecting print data 120 and applying print data 120 in suitable form to carriage 125, e.g., to suitably excite or "fire" the various inkjet ejection elements associated with the orifices on one or more print cartridges mounted on carriage 125. Controller 127 also manipulates pickup of media 116 from tray 118, operation of transport 121 moving media 116 along path 117, and delivery of media 116 to output tray 119. A user interface 154 of machine 100 includes a user display 154*a* and user buttons 154*b*.

Machine 100 also includes an imaging function. A scanning bed 114 receives in face-to-face relation imaged media 116*b*. An imaging array 115 reciprocates below bed 114 and, under direction of controller 127, collects scan data 122 therefrom. It will be understood, however, that a particular machine 100 can include in addition or in the alternative a document feeding function (not shown) moving imaged media 116*b* past a fixed array 115 to produce scan data 122. Machine 100 thereby produces scan data 122 representing imaged media 116*b* and provides in image data 126 a representation of such imaged media 16*b*. Thus, machine 100 serves as a multifunction printing and scanning device. Controller 127 makes use of scan data 122 in a first mode as applied to an imaging function, e.g., to provide image data 126 to an external device (not shown) or a separate internal process such as a FAX or copying process (not shown) provided by machine 100. In a second mode, however, machine 100 makes use of scan data 122 as applied to a calibration procedure, e.g., procedure 150 of FIG. 4, executed by controller 127.

At a suitable time, e.g., when a user 156 replaces an inkjet cartridge within machine 100, machine 100 prompts user 156 to execute a calibration procedure. For example, machine 100 provides such prompt at display 154*a*. The user acknowledges by reply at buttons 154*b*. In response, machine 100 produces a calibration page 116*d* by collecting one or more media 116 from tray 118. Data supporting production of a calibration page 16*d* may be taken from a variety of sources. In the alternative, machine 100 can simply produce a calibration page 116*d* in response to a predetermined event such as, for example, a user 156 mounting a print cartridge. Calibration page 116*d* may include instructions in support of the calibration procedure.

The user 156 receives calibration page 116*d* and places calibration page 116*d* on scanner bed 114. The user 156 may place the page according to instructions presented at display 154*a* and/or on calibration page 116*d*. In the alternative, for a machine 100 including a document feeding function (not shown) the user 156 places the calibration page 116*d* in a document feeder for imaging. Once so placed, e.g., on bed 114, user 156 can communicate such condition to machine 100 via buttons 154*b*. In response, machine 100 scans calibration page 116*d* and applies the resulting scan data 122 to a calibration procedure, e.g., procedure 150 of FIG. 4. In some embodiments, procedure 150 may be executed by, for example, controller 127 of machine 100. Calibration procedure 150 analyzes the calibration page 116*d* and produces calibration data 152 for controlling operation of printing component 112 of machine 100. In the particular embodiment illustrated in FIG. 3, calibration data 152 can exist internally relative to controller 127 and any associated memory devices used thereby. It will be understood, however, that analysis of calibration data 152 in implementation of the various embodiments illustrated herein can occur in a variety of locations. Calibration data 152 can indicate, for example, a need for modification of timing of ink droplet ejection within the printing components of machine 100. By suitably adjusting the timing of ink droplet ejection as a function of calibration data 152, ink droplet trajectories arrive at an intended location and in appropriate relative positions to one another on media 116 according to a given print job, e.g., according to incoming print data 120 so as to produce precision print imaging as a function thereof. Similarly, calibration data 152 can indicate, for example, a need for modifying the pairing of ink-ejecting orifices of different cartridges on carriage 125. In other words, vertical offsets indicated in calibration data 152 can indicate an improved orifice pairing arrangement to reduce or eliminate such vertical offsets between paired orifices on different print cartridges mounted on carriage 125. Other operational aspects of machine 100 can be modified as a function of detected print quality deficiencies. Calibration data 152 can indicate, for example, a need for modifying interpretation of print data 120 to correct detected horizontal and vertical misalignment. Bi-directional printing operation can be modified as a function of indicated need in calibration data 152 to improve alignment between print imaging produced indifferent scan directions.

As a result, when a user replaces or remounts one or more print cartridges of machine 100, machine 100 executes, with user 156 assistance and interaction, a calibration procedure including production of a calibration page 16*d*, interaction with a user to place the calibration page 16*d* in suitable relation to a scanning portion of machine 100, producing scan data 122 representing the calibration page 16*d*, and producing calibration data 152 in support of calibrating a printing component 112 of machine 100.

Figure 4:
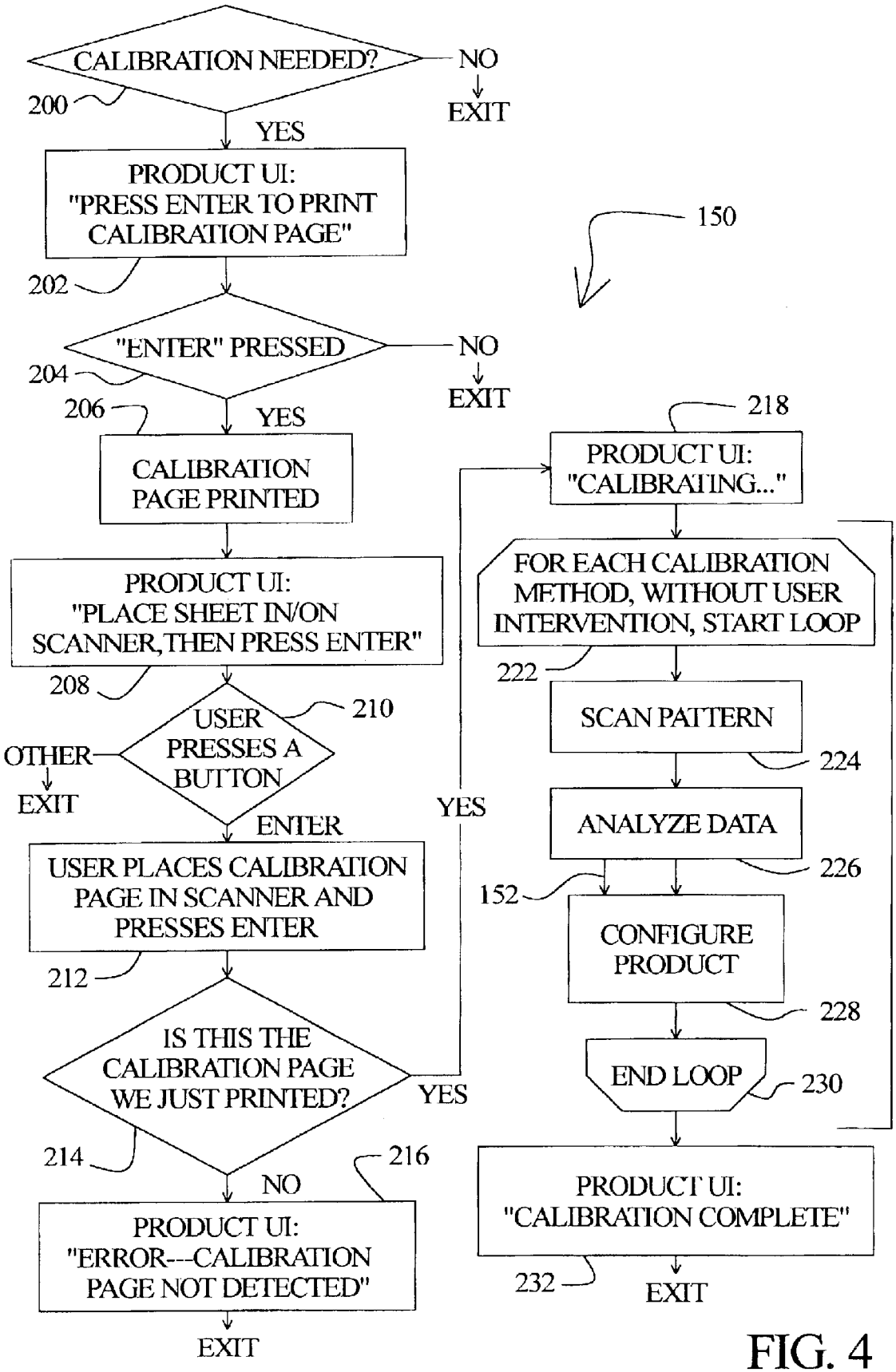
FIG. 4 illustrates by flow chart a calibration procedure according to an embodiment of the present invention including user intervention and interaction with the multifunction printing and imaging machine of FIG. 2.

FIG. 4 illustrates by flow chart one example of a calibration procedure 150 executed by machine 100 in cooperation with user 156. In FIG. 4, decision block 200 represents machine 100 detecting need for calibration. For example, when an inkjet print cartridge is mounted in machine 100, machine 100 requests or requires that user 156 execute a calibration procedure. As may be appreciated, however, a user 156 detecting misalignment of print imaging produced by machine 100 can invoke by way of user interface 154 execution of a calibration procedure. When a calibration procedure is to be executed, processing branches at block 200 into block 202. Otherwise, processing branches from block 200 into other procedures unrelated to calibration. In block 202, machine 100 presents by way of user interface 154 a prompt to user 156 to "press ENTER to print calibration page." In response, machine 100 advances to decision block 204 pending key 154*b* activity by user 156. In block 204, if the user presses ENTER as requested in block 202, processing advances to block 206 where machine 100 prints a calibration page 116*d*. Otherwise, processing branches at block 204 to other processing, e.g., unrelated to calibration. After machine 100 prints a calibration page 116*d* in block 206, processing advances to block 208 where machine 100 presents to user 156 a display "PLACE SHEET IN/ON SCANNER, THEN PRESS ENTER." As may be appreciated, a variety of document feeding or presentation methods are used in scanning devices including, but not limited to, placement on flatbed scanning devices, and insertion into document feeding devices which pass media by a scanning device. Processing then advances to decision block 210 pending a key press by user 156. If the user presses ENTER as requested in block 208, then processing advances to block 212. Otherwise, processing branches at block 210 to other processing unrelated to calibration. In block 212, the user 156 places the calibration page 116*d* in/on the scanner and presses the ENTER button.

In decision block 214, machine 100 determines whether or not the scan data 122 just produced is a representation of the calibration page 116*d*. In other words, machine 100 determines whether or not user 156 has placed the calibration page 116 in/on the scanner. As may be appreciated, the calibration page 116*d* can contain certain specific identifying information distinguishing it from other print imaging produced by machine 100. Machine 100 can include programming to recognize its own calibration page 116*d* in scan data 122. If the scan data 122 just taken does not represent the calibration page 116*d*, then processing branches to error block 216 where the user 156 is informed of an error condition and calibration programming exits thereat. Otherwise, processing branches at block 214 to block 218 where machine 100 presents a "CALIBRATING . . . " prompt to user 156 informing user 156 that calibration is underway.

Blocks 222–230 represent a loop structure where, for each calibration aspect available, machine 100 executes appropriate scanning, analyzing, and configuring. For example, each iteration of loops 222–230 can accomplish suitable scanning, analyzing, and configuring according to different calibration features such as, but not limited to, horizontal alignment, vertical alignment, bi-directional printing alignment, color accuracy, and energy consumption. In such process, machine 100 detects and recognizes fiducial marks available on calibration page 116*d* to identify in relation thereto particular calibration marks, and selects or isolates areas of the scan data 122 for analysis of each calibration pattern and analyzes each isolated or selected portion of scan data 122 to determine how to configure machine 100. Thus, processing iterates beginning at block 224 where machine 100 collects or "scans" from data 122 a particular calibration mark, analyzes in block 226 the particular or collected scan data 122 representing the particular calibration mark, and configures machine 100 by producing calibration data 152 and adjusting operation of printing component 112 based on the calibration data 152 in block 228. Blocks 224–226 can be repeated for each available calibration method. Once, the calibration procedure is complete, processing in block 232 presents to user 156 a "CALIBRATION COMPLETE" prompt informing the user that the calibration procedure has been completed fully and normal use of machine 100 can continue.

Figure 5:
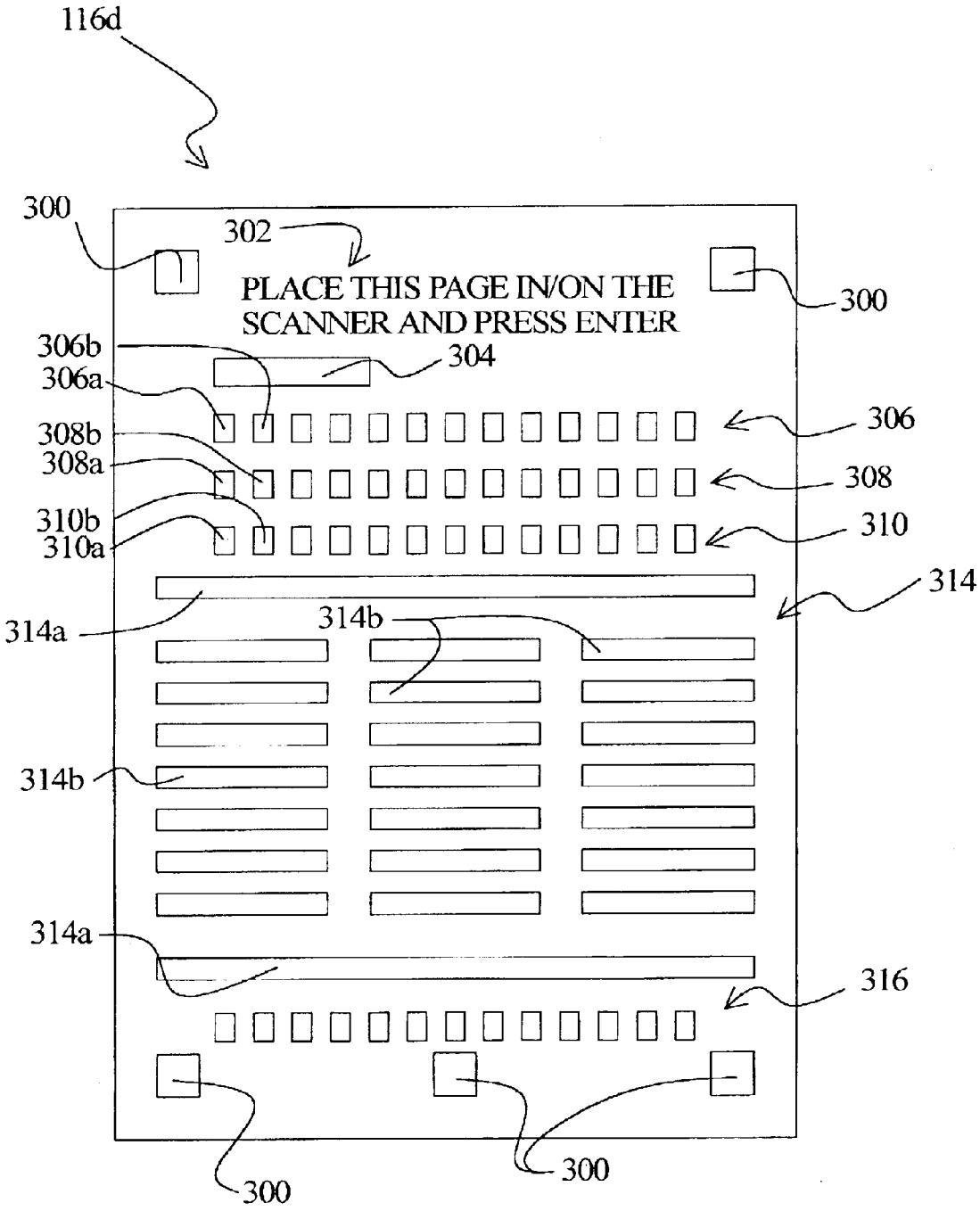
FIG. 5 illustrates a calibration page according to an embodiment of the present invention produced in support of a calibration procedure.

FIG. 5 illustrates by example, one form of calibration page 116*d*. It will be understood, however, that the illustration of calibration page 116*d* can correspond to a calibration page 16*d* as discussed above. Furthermore, the particular calibration marks illustrated in FIG. 5 are merely illustrative and not exhaustive. There are a variety of calibration methods and marks employed in modification of a printing component based on detected horizontal and vertical offsets as well as bi-directional control features and magnitude of energy applied control features. Depending on the particular configuration of a given printer mechanism, some of the calibration marks shown in FIG. 5 can be repeated for additional or pairs of print cartridges used. Thus, calibration page 116*d* as illustrated in FIG. 5 is by example and a more exhaustive use of calibration marks, including additional marks and repetition of illustrated marks, can be used in implementation of a calibration procedure as described herein.

In FIG. 5, calibration page 116*d* as produced by machine 100 includes a variety of markings useful in implementing the calibration procedure described herein. Calibration page 116*d* includes fiducial marks 300. In this particular example, calibration page 116*d* includes marks 300 comprising rectangular shapes at particular locations relative to other items on calibration page 116*d*. As may be appreciated, machine 100 references fiducial marks 300 for purposes of identifying the location of other items on page 116*d*. In other words, particular calibration marks appear at particular predetermined locations on page 116*d* in relation to fiducial marks 300. In this manner, machine 100 has a reference or standard for identifying locations of markings on page 116*d* and, more particularly, particular calibration marks thereon. Calibration page 116*d* can include a body of text or graphic objects 302 providing instructions to a user 156. Thus, in addition to providing instructions to a user 156 on machine 100 at display 154*a*, calibration page 116*d* also bears instructions in support of an interactive yet substantially automated calibration procedure. For example, the instructions in text body 302 can instruct the user to "PLACE THIS PAGE IN/ON THE SCANNER AND PRESS ENTER."

Calibration page 116*d* includes a calibration mark 304 providing a basis for determining an amount of energy required to operate the ink cartridge of machine 100. In producing calibration mark 304, machine 100 uses progressively less and less energy. At some point, i.e., at some level of energy applied in producing mark 304, mark 304 becomes unacceptable, e.g., weak, in presentation. In analyzing mark 304, machine 100 determines a point at which an energy level is reduced but sufficient to produce mark 304 at given quality standards. Detecting this portion of mark 304 provides a basis for later operating printer component 112 of machine 100 at an energy level reduced but sufficient to produce quality print imaging.

Calibration page 116*d* includes a series of calibration marks 306 used to determine a black cartridge bi-directional alignment. Marks 306 comprise alternating marks 306*a* and 306*b* or odd marks 306*a* and even marks 306*b*. For example, odd marks 306*a* can be printed while the carriage is moving from left-to-right while even marks 306*b* can be printed from right-to-left. All marks 306 originate from one print cartridge. Thus, a separate set of calibration marks 306 can be produced for each print cartridge used in machine 100. Detecting spacing between odd marks 306*a* and even marks 306*b*, e.g., spacing between adjacent ones of marks 306*a* and 306*b*, provides indication of the horizontal alignment of a single print cartridge producing print imaging in a bi-directional fashion. Thus, in analyzing marks 306, calibration procedure 150 measures horizontal spacing between marks 306*a* and 306*b* and determines need for calibration of the bi-directional printing features of machine 100, e.g., determines the accuracy or alignment of print imaging produced from left-to-right relative to print imaging produced from right-to-left.

Calibration page 116*d* includes a series of calibration marks 308 used for determining color cartridge bi-directional alignment. Marks 308 are similar to marks 306, but provide indication of alignment for a different cartridge. As with marks 306, marks 308 originate from one print cartridge, e.g., a selected color print cartridge. Odd marks 308*a* are printed in one direction, e.g., from left-to-right, while even marks 308*b* are printed in the opposite direction, e.g., from right-to-left. As with marks 306, detecting spacing between marks 308*a* and 308*b*, e.g., adjacent ones of marks 308*a* and 308*b*, provides basis for determining alignment in the bi-directional printing mechanism to produce coordinated, e.g., aligned, printing in both left-to-right and right-to-left printing modes.

Calibration page 116*d* includes a series of calibration marks 310 for determining cartridge-to-cartridge horizontal alignment. Calibration marks 310 originate from two print cartridges. This pattern produces basis for determining horizontal offset between two print cartridges. For example, marks 310 include alternating marks 310*a* and 310*b*. Marks 310*a* originate from a first print cartridge, e.g., from a black ink print cartridge, and marks 310*b* originate from another cartridge, e.g., a selected one of the color print cartridges. Detecting spacing between marks 310*a* and 310*b*, e.g., between adjacent ones of marks 310*a* and 310*b*, provides basis for determining horizontal alignment between two print cartridges, e.g., between the cartridge producing marks 310*a* and the cartridge producing marks 310*b*. Variation in such spacing from an expected variation may be reflected as an offset in calibration data 152 to modify operation of printer component 112 and thereafter produce appropriate horizontal spacing therebetween, e.g., adjust timing in production of ink droplets from the cartridge producing marks 316*b* relative to the cartridge producing marks 310*a*. As may be appreciated, additional series of marks 310 may be produced to calibrate other print cartridges relative to a reference cartridge. For example, a second series of marks 310 also using the black ink cartridge but a different color cartridge provides calibration of a second color cartridge to the black ink cartridge. In this manner, a set of color ink cartridges can be calibrated, e.g., horizontal offsets detected, relative to a reference cartridge, e.g., relative to the black ink cartridge, and thereby produce a reliable set of calibration data 152 for modifying subsequent operation of printer component 112 in producing precise, e.g., well aligned, print imaging.

Calibration page 116*d* includes a set of calibration marks 314 for determining cartridge-to-cartridge vertical alignment. While not illustrated in detail herein, but as known in the art, marks 314 comprise a series of stepped lines produced by a first print cartridge and a series of overlaid horizontal lines produced by a second print cartridge. Vertical alignment of the second cartridge relative to the first cartridge may be inferred by detecting a magnitude of reflectance from a mark 314. Thus, in an actual implementation a set of marks 314 can be presented for each print cartridge, for each color cartridge, for calibration thereof relative to a reference cartridge, e.g., a black ink cartridge. Calibration marks 314 include a set of primary calibration marks 314*a* and a set of secondary calibration marks 314*b*. Generally, calibration marks 314*a* provide a gross estimation of cartridge-to-cartridge vertical alignment. Marks 314*a* may be analyzed for a magnitude of reflectance at locations thereacross. A location of a given level of reflectance within a given mark 314*a* indicates a gross calibration of cartridge-to-cartridge vertical alignment sufficient to select one or a set of marks 314*b* for fine indication of vertical alignment. Marks 314*a* thereby reduce selection, e.g., determine which of marks 314*b* need be analyzed for reflectance. Thus, calibration procedure 150 first analyzes one of marks 314*a* and then determines which of marks 314*b* need be analyzed for reflectance values. By suitably placing marks 314*a*, e.g., above and below as seen in FIG. 5, top-to-bottom and bottom-to-top scanning and analysis of calibration page 116*d* is available. In other words, a calibration mark 314*a* can be encountered before a mark 314*b* is encountered. In this manner, a calibration page 116*d* can be placed in the scanner in any orientation, and the scanner will detect properly its orientation. For example, by placing two fiducial marks 300 at the top of page 116*d* and three fiducial marks at the bottom of page 116*d*, analysis of scan data representative thereof provides an indication of the orientation of page 116*d* as presented to the scanner.

Calibration page 116*d* includes a series of calibration marks 316 for determining accuracy of colored print imaging produced by machine 100. Each of calibration marks 316 bear a predetermined hue or target color. For example, machine 100 may include a set of print cartridges carrying particular base colors. By appropriately mixing such base colors, e.g., selecting one or more ink droplets from one or more such cartridges and placing such selected ink droplets at particular locations on media 116, a target color can be achieved by mixing of the colors held in the various color cartridges. In any event, machine 100 if operating properly, e.g., if properly calibrated with respect to suitable mixing of such colors, will produce accurately an intended hue or target color. Each of calibration marks 316, therefore, bear a predetermined hue or target color. When calibration marks 316 are analyzed by calibration block 150, any variation in such calibration marks 316 relative to the intended hue or target color can represent need for calibration in the operation of machine 100 in achieving such color or hue in print imaging produced thereby.

Figure 6:
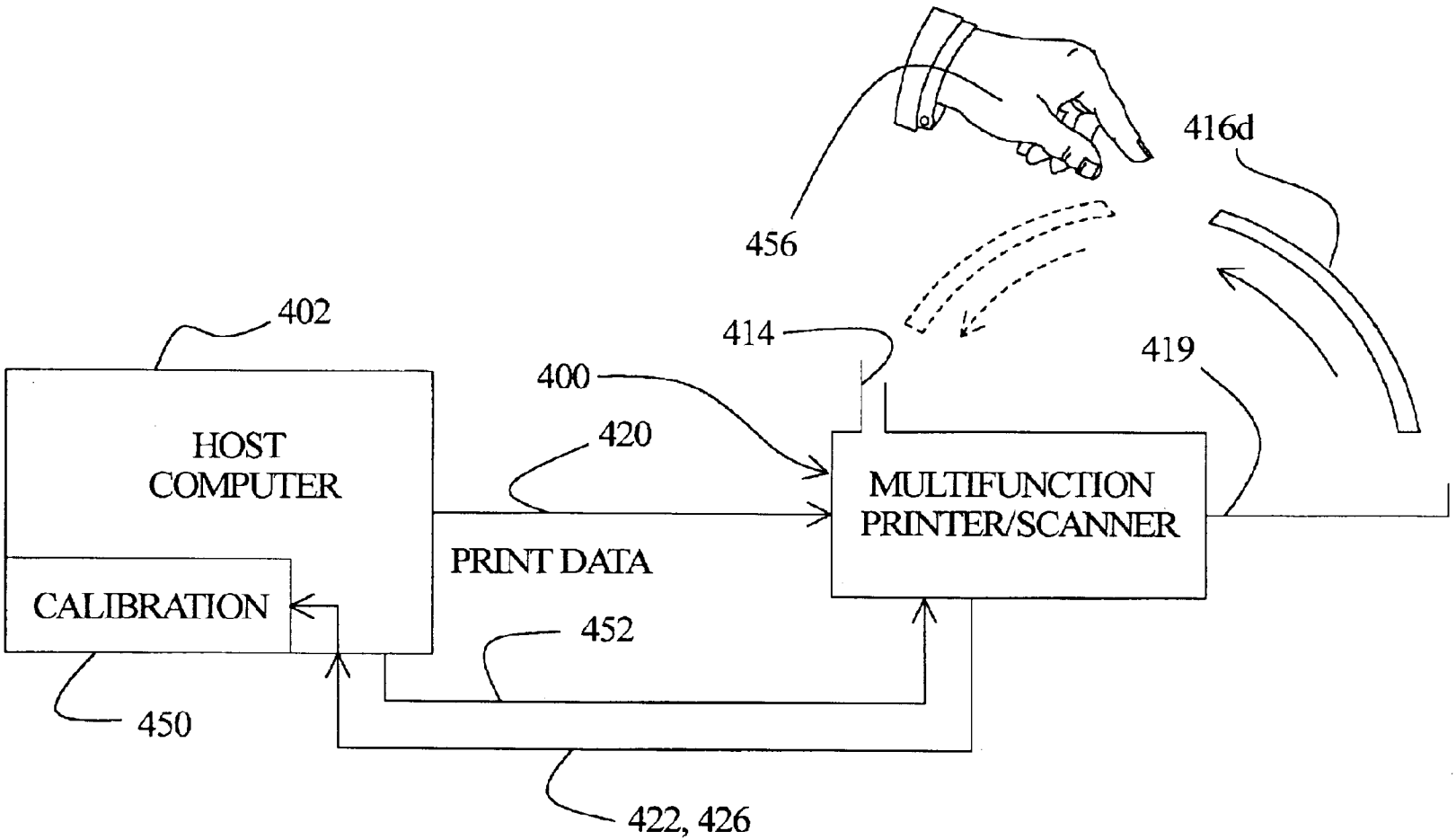
FIG. 6 illustrates a third embodiment according to an embodiment of the present invention of multifunction printing and imaging machine calibration.

FIG. 6 illustrates an embodiment showing a multifunction printer/scanner 400 coupled to a host computer 402. Host computer 402 delivers to multifunction printer/scanner 400, by suitable communication path, print data 420. Generally, multifunction printer/scanner 400 reacts to printer data 420 by producing print imaging on media 416. Multifunction printer/scanner 400 delivers imaged media 416 at its output tray 419. As relevant to the present discussion, printed data 420 represents a calibration pattern and multifunction printer/scanner 400 produces a calibration page 416*d*, i.e., applies print imaging representing calibration marks to media. A user 456 participates in calibration by moving calibration page 416*d* from tray 419 to a document feeder 414 (or flatbed scanning device) of multifunction printer/scanner 400. Multifunction printer/scanner 400 produces scan data 422 representing calibration page 416*d* and delivers scan data 422 (or image data 426) to host computer 402. Host computer 402 recognizes the presence of a calibration page 416*d* in scan data 422 (or image data 426), and applies scan data 422 (or image data 426) to a calibration component 450 of host computer 402. Calibration component 450 applies appropriate analysis as described herein above and produces calibration data 452 for application to multifunction printer/scanner 400, e.g., for modifying operation of multifunction printer/scanner 400 in light of detected print image quality deficiencies represented in calibration page 416*d*. Thereafter, multifunction printer/scanner 400 operations reflect calibration or alignment represented in calibration data 452.

Thus, host computer 402 and multifunction printer/scanner 400 cooperate with a user 456 to execute a calibration or alignment procedures for multifunction printer/scanner 400. Display features of multifunction printer/scanner 400 or display features of host computer 402 may support user 456 participation. In either case, user 456 participates in alignment or calibration only to the extent that user 456 need move a calibration page 416*d* from an output tray 419 to a scanner input, e.g., document feeder 414.

Figure 7:
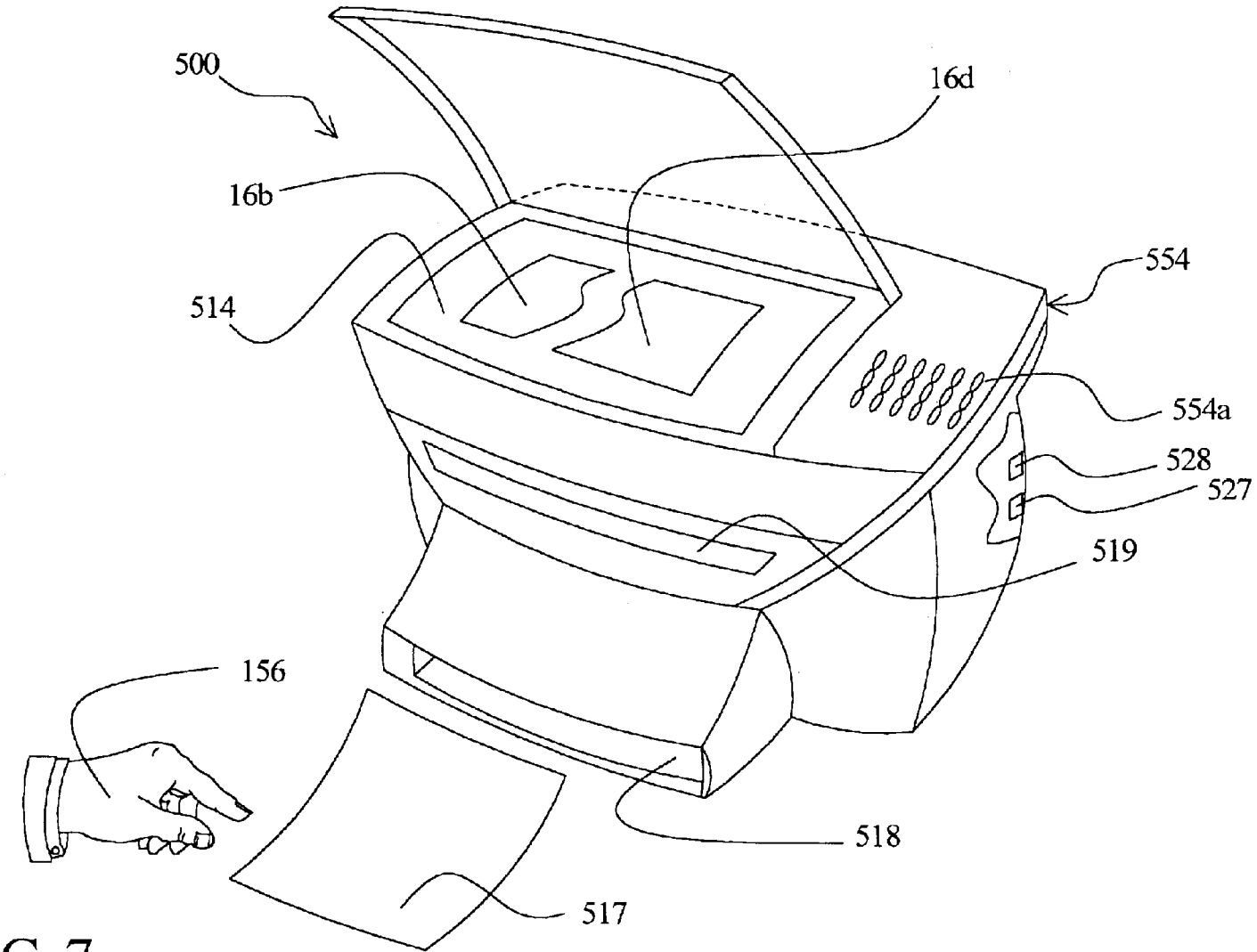
FIG. 7 illustrates a fourth embodiment according to an embodiment of the present invention of a stand-alone multifunction device.

FIG. 7 illustrates an embodiment of the present invention showing a multi-function device 500 operating as a stand-alone device. In other words, device 500 can, if desired, operate independently of a host computing device. Device 500 includes a scanning or imaging component 514. In the illustrated example, imaging component 514 includes a flatbed scanning device. It will be understood, however, that a document feeder (not shown) may be incorporated in addition to or as a substitute for the illustrated flatbed scanning device. Device 500 includes a printing component (not illustrated) which can comprise a printing component similar to those previously described and including one or more inkjet printing cartridges benefiting from calibration as described herein. Device 500 includes a user interface 554 including a set of user-operated buttons 554*a*. Device 500 includes a media source or input tray 518 and passes media as taken therefrom through the printing component of device 500. Following application of print imaging on such media, device 500 delivers printed media at an output slot 519.

Thus, device 500 can operate in a variety of modes. Device 500 can serve as a copying device whereby media placed on imaging component 514 is scanned and reproduced as print imaging on media taken from tray 518 and delivered at slot 519. In addition, device 500 can operate as a fax machine when suitably coupled to a communication interface, e.g., to a telephone line. In such mode, device 500 images media placed on, or fed into, imaging component 514 and delivers scan data representative thereof as a fax transmission.

Figure 8:
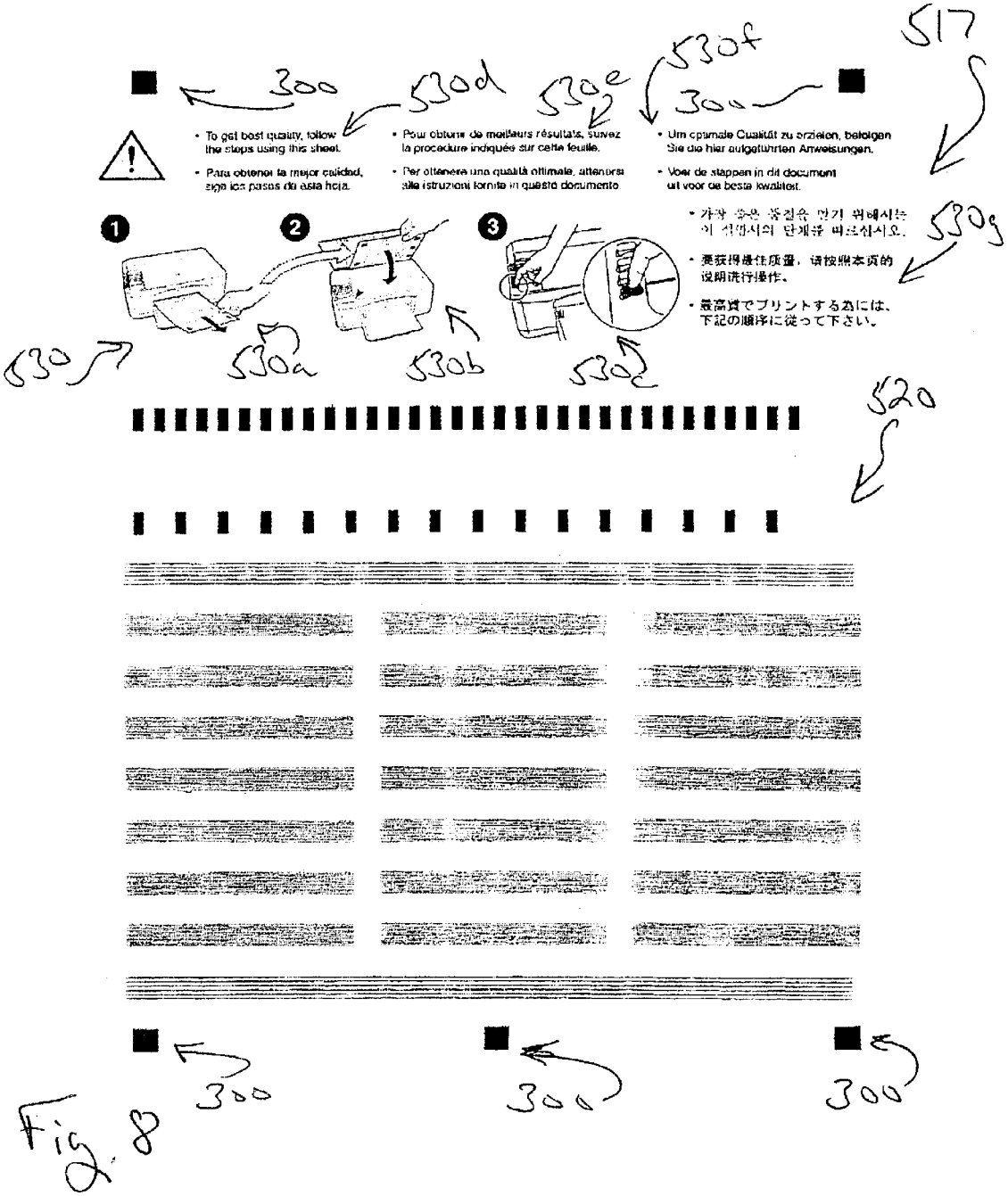
FIG. 8 illustrates a calibration page according to an embodiment of the present invention as produced by the device of FIG. 7.

Because device 500 uses one or more print cartridges (not shown but similar to those previously described) in applying print imaging to media, device 500 benefits from calibration procedures applied thereto as described herein above relative to previous embodiments of the present invention including inkjet printing devices. Device 500 includes a processing device or controller 527 and a memory element 528. Controller 527 orchestrates operation of device 500 in a manner similar to operation of previously described embodiments of the present invention. Memory element 528 stores instructions executable by processing device 527 for printing the calibration page, analyzing the printed calibration page, and calibrating the device 500 accordingly. In addition, memory element 528 holds a representation of a calibration page 517. FIG. 8 illustrates an example of a calibration page 517.

Device 500 may be programmed to detect a need for calibration of its printing components in a manner similar to previously described embodiments of the present invention. In other words, for example, device 500 can detect when one or more print cartridges (not shown in FIG. 7 but similar to those shown in previous embodiments) have been mounted relative to device 500. Further, device 500 can, for example, react to a user 156 request as presented at buttons 554*a*, to re-calibrate device 500. Device 500 produces from a representation thereof stored in memory element 528 the calibration page 517. In this manner, device 500 may be implemented as a low-cost device which need not include any text or graphics based LCD user interface. Also, device 500 need not include any font rendering capability to localize text instructions in several languages as part of the printed calibration page 517. In other words, calibration page 517 can be stored as image data in memory element 528 and produced by application thereof to the printing components of device 500 when needed, e.g., when a calibration procedure is indicated by mounting a print cartridge or by user 156 request. Calibration page 517 includes a set of fiducial marks 300 as previously described as well as a set of calibration marks generally referenced as marks 520 on page 517. In the alternative, portions of calibration page 517 need not be stored graphically, e.g., calibration marks 520 and fiducial marks 300 could be produced algorithmically by suitably programming controller 527. As described herein above, calibration marks 520 may be used to detect a variety of alignment and operational conditions associated with calibration features of device 500 including, but not limited to, horizontal alignment, vertical alignment, bi-directional printing alignment, color accuracy, and energy consumption. Generally, calibration marks 520 as presented on calibration page 517 may be used in a manner similar to that described herein above, e.g., in a manner similar to calibration page 116*d*.

Calibration page 517 includes a user instruction section 530. User instruction section 530 includes a set of pre-stored graphic instructions depicting calibration steps. More particularly, calibration page 517 includes a first graphic 530*a* depicting ejection of calibration page 517 from device 500. A second graphic 530*b* portrays placement of calibration page 517 upon the imaging portion of device 500. Graphic 530*c* depicts user operation of an interface button 554*a* to initiate calibration by device 500. In other words, to execute a calibration procedure, e.g., similar to that illustrated in FIG. 4, device 500 scans calibration page 517, analyzes the resulting scan data, and produces appropriate calibration data for modifying subsequent operation of device 500 in a manner similar to above-described embodiments of the present invention. In addition to graphics 530*a*–530*c*, calibration page 517 can include a set of instruction in a variety of languages. Thus, instruction sets 530*d*–530*g* provide instructions to user 156 corresponding to graphics 530*a*–530*c*, but in a variety of languages.

Thus, device 500 provides calibration as described herein, but in a stand-alone, low-cost device. By storing a representation of all or a portion of calibration page 517 within device 500, e.g., as graphics 530 within memory element 528, calibration occurs without support from an associated computing device, e.g., without device 500 being coupled to or interacting with a host PC.

It will be appreciated that the present invention is not restricted to the particular embodiments that have been described and illustrated, and that variations may be made therein without departing from the scope of the invention as found in the appended claims and equivalents thereof.

What is claimed is:

1. An apparatus comprising:

a printing component receiving media, applying print imaging thereto, and delivering said media to a first location, said apparatus selectively applying at least one calibration mark and graphic user calibration instructions depicting user transfer of the media as said print imaging; and an imaging component receiving imaged media at a second location and producing scan data representative thereof, said apparatus selectively analyzing said at least one calibration mark and producing calibration data.

2. An apparatus according to claim 1 wherein said apparatus includes a memory element, said memory element storing a representation of said at least one calibration mark.

3. An apparatus according to claim 1 wherein said apparatus selectively applies said at least one calibration mark in response to at least one of user request for calibration and detection of a basis for calibration.

4. An apparatus according to claim 3 wherein said apparatus includes a print cartridge and said basis for calibration includes mounting of a print cartridge.

5. An apparatus according to claim 1 wherein said media comprises a sheet-form ink-receptive media.

6. An apparatus according to claim 1 wherein said printing component comprises an inkjet printing component.

7. An apparatus according to claim 6 wherein said inkjet printing component comprises at least one print cartridge.

8. An apparatus according to claim 1 wherein said calibration mark indicates at least one of horizontal alignment, vertical alignment, bi-directional printing alignment, color accuracy, and energy consumption of said apparatus.

9. An apparatus according to claim 1 wherein said apparatus receives said imaged media at said second location by user participation.

10. An apparatus according to claim 9 wherein said user participation occurs in response to said apparatus prompting said user participation.

11. An apparatus according to claim 10 wherein said user participation includes moving said media from the first location to the second location.

12. An apparatus comprising:

a printing component receiving media, applying print imaging thereto, and delivering said media to a first location, said apparatus selectively applying at least one calibration mark as said print imaging; and an imaging component receiving imaged media at a second location and producing scan data representative thereof, said apparatus selectively analyzing said at least one calibration mark and producing calibration data; and a memory element, said memory element storing a representation of said at least one calibration mark, said printing component producing in association with said at least one calibration mark a graphic depiction of instructions associated with user participation in delivering said imaged media to said imaging component, said graphic representation being stored in said memory element.

13. A method of printing apparatus calibration comprising:

printing a calibration page, said calibration page including graphic user instructions depicting user transfer of media and prompting user application of said calibration page to an imaging component of said apparatus;

scanning said calibration page at said imaging component and producing calibration data as a function thereof; and applying said calibration data to subsequent operation of said printing apparatus.

14. An apparatus according to claim 13 wherein said step of printing a calibration page comprises accessing a memory element of said printing apparatus, said memory element storing a representation of at least a portion of said calibration page.

15. An apparatus according to claim 13 wherein said printing step comprises printing at least one calibration mark.

16. An apparatus according to claim 15 wherein said at least one calibration mark comprises at least one of an indicator of horizontal alignment between a pair of print cartridges producing said calibration page, an indicator of vertical alignment between a pair of print cartridges producing said calibration page, an indicator of bi-directional printing alignment, an indicator of energy consumption used in producing said print imaging; and an indicator of production of selected print imaging coloration.

17. An apparatus according to claim 13 wherein said printing a calibration page occurs in response to at least one of user request and mounting of an ink-ejecting print cartridge of said apparatus.

18. An apparatus according to claim 13 wherein said method of printing apparatus calibration includes said printing a calibration page by operation of an inkjet print cartridge.

19. An apparatus according to claim 13 wherein said scanning includes production of scan data representing said calibration page and analysis of scan data to produce said calibration data.

20. A method of printing apparatus calibration comprising:

printing a calibration page including accessing a memory element of said printing apparatus, said memory element storing a representation of at least a portion of said calibration page;

prompting user application of said calibration page to an imaging component of said apparatus;

scanning said calibration page at said imaging component and producing calibration data as a function thereof; and applying said calibration data to subsequent operation of said printing apparatus, said calibration page including a graphic depiction of user participation in support of said prompting step.

21. A combined printing and imaging apparatus comprising:

printing means for producing a calibration page;

imaging means for producing scan data representative of imaged media applied thereto;

interface means for prompting user application of said calibration page to said imaging means, said interface means including graphic user instructions provided on said calibration page and depicting user transfer of media; and calibration means responsive to said scan data representative of said calibration page for producing calibration data applicable to said printing means in calibration thereof.

22. An apparatus according to claim 21 wherein said printing means includes a memory element storing data representative of at least a portion of said calibration page.

23. An apparatus according to claim 22 wherein said printing means comprises inkjet printing means.

24. An apparatus according to claim 22 wherein said apparatus includes a first location and a second location, said first location receiving imaged media from said printing means and said second location receiving print imaging for application to said imaging means.

25. An apparatus according to claim 22 wherein said calibration page includes at least one calibration mark indicating at least one of horizontal alignment, vertical alignment, energy consumption, accurate color production, and bi-directional printing alignment.

26. An apparatus according to claim 22 wherein said printing means produces print imaging representing print data applied thereto.

27. A combined printing and imaging apparatus comprising:

printing means for producing a calibration page, said printing means including a memory element storing data representative of at least a portion of said calibration page;

imaging means for producing scan data representative of imaged media applied thereto;

interface means for prompting user application of said calibration page to said imaging means; and calibration means responsive to said scan data representative of said calibration page for producing calibration data applicable to said printing means in calibration thereof, said stored data including a graphic representation of user application of said calibration page to said imaging means.

28. For a combined printing and imaging apparatus, a calibration method comprising:

producing scan data representative of imaged media applied to an imaging component of said apparatus, said imaged media selectively including graphic user calibration instructions depicting user transfer of media; and selectively applying said scan data in a first mode as image data and in a second mode to a calibration component.

29. A method according to claim 28 wherein said calibration component analyzes said scan data when the scan data is representative of at least one calibration mark produced by a printing component of said apparatus, and wherein said calibration component produces calibration data as a function thereof and useable in modifying subsequent operation of said printing component.

30. A method according to claim 28 wherein said scan data as applied in said first mode includes availability thereof to at least one of a device external to said apparatus and a process internal to said apparatus.

31. A method according to claim 28 wherein said calibration component resides within said printing and imaging apparatus.

32. A method according to claim 28 wherein said calibration component resides external to said printing and imaging apparatus.

33. A combined inkjet printer and imaging system comprising:

a printing component including at least one print cartridge, said printing component responsive to calibration data in modifying operation thereof, said printing component selectively producing a calibration page including graphic user instruction at a first location and depicting user transfer of media;

an imaging component producing scan data representative of imaged media applied thereto, said imaging component receiving at a second location as imaged media said calibration page; and a calibration component selectively receiving scan data representing said calibration page and producing as a function thereof calibration data for application to said printing component.

34. A system according to claim 33 wherein said combined inkjet printer and imaging apparatus includes a host computing device, said calibration component being maintained within said host computing device.

35. A system according to claim 33 wherein said combined inkjet printer and imaging apparatus comprises a host computing device and a multifunction printing and imaging device, said printing component and said imaging component residing within said multifunction printing and imaging device and said calibration component residing within said host computing device.

36. A system according to claim 33 wherein said combined inkjet printer and imaging apparatus comprises a multi-function apparatus including as components thereof said printing component, said imaging component, and said calibration component.

37. A system according to claim 36 wherein said calibration component selectively receives said scan data when said imaging component produces scan data representative of said calibration page.

38. A system according to claim 33 wherein said apparatus prompts a user to collect said calibration page at said first location and deliver said calibration page at said second location.

39. A system according to claim 33 wherein said calibration page includes calibration marks indicating at least one of horizontal alignment, vertical alignment, energy consumption, accurate color production, and bi-directional printing alignment.

40. A method of calibrating a combined inkjet printing and imaging device, said method comprising:

detecting need for calibration of an inkjet printing component of said device;

producing in response to said detecting step a calibration page including graphic user instructions depicting user transfer of media;

instructing a user to apply said calibration page to an imaging component of said device;

detecting presentation of said calibration page to said imaging component;

analyzing when detected said calibration page and producing as a function thereof calibration data;

applying said calibration data to said inkjet printing component; and modifying subsequent operation of said inkjet printing component as a function of said calibration data.

41. A method according to claim 40 wherein said detecting a need for calibration comprises detecting mounting of a print cartridge in said inkjet printing component of said device.

42. A method according to claim 40 wherein said analyzing step occurs in a host computing device coupled to said combined inkjet printing and imaging device.

43. A method according to claim 40 wherein said analyzing step occurs within said combined inkjet printing and imaging device.

44. A method according to claim 40 wherein said method presents for user collection said calibration page at a first location and receives said calibration page at said imaging component at a second location.

45. A method according to claim 40 wherein said calibration page includes calibration marks indicating at least one of horizontal alignment, vertical alignment, accuracy of coloration, bi-directional printing operation, and energy consumption.

46. A method according to claim 40 wherein said detecting presentation of said calibration page includes producing scan data representative of said calibration page and wherein said analyzing step includes analyzing said scan data representing said calibration page.

47. A processor-readable medium having processor-executable instructions thereon which, when executed by a processor, cause the processor to:

produce a calibration page on a printing component, said calibration page including graphic user instructions depicting user transfer of media which prompt a user to apply said calibration page to an imaging component;

scan said calibration page;

analyze data representing said scanned calibration page and produce calibration data as a function thereof; and modify subsequent operation of said printing component based on said calibration data.

48. A medium according to claim 47 wherein said producing a calibration page occurs in response to at least one of a user request and a mounting of a print cartridge in said printing component.

49. A medium according to claim 47 wherein said producing a calibration page includes printing at least one calibration mark.

* * * * *